US006771479B2

(12) United States Patent
Vanheesbeke

(10) Patent No.: US 6,771,479 B2
(45) Date of Patent: Aug. 3, 2004

(54) METHOD AND DEVICE FOR CONTROLLING A SELECTION DEVICE WITH SOLENOIDS FOR A WEAVING MACHINE

(75) Inventor: Stefaan Vanheesbeke, Zwevegem (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 271 days.

(21) Appl. No.: 09/890,972

(22) PCT Filed: Dec. 7, 2000

(86) PCT No.: PCT/EP00/11775

§ 371 (c)(1),
(2), (4) Date: Oct. 12, 2001

(87) PCT Pub. No.: WO01/42546

PCT Pub. Date: Jun. 14, 2001

(65) Prior Publication Data

US 2003/0076646 A1 Apr. 24, 2003

(30) Foreign Application Priority Data

Dec. 8, 1999 (BE) ..... 9900803

(51) Int. Cl.[7] ..... H01H 47/100

(52) U.S. Cl. ..... 361/152; 361/154; 361/91; 361/160; 361/172

(58) Field of Search ..... 361/152, 154, 361/91, 160, 166, 172, 183, 199

(56) References Cited

U.S. PATENT DOCUMENTS 3,549,955 A 12/1970 Crawford
4,266,261 A 5/1981 Streit et al.
4,283,748 A * 8/1981 Gotoh ..... 361/154
4,511,945 A 4/1985 Nielsen
5,540,261 A * 7/1996 McGinley ..... 139/11
5,864,457 A * 1/1999 Kates et al. ..... 361/111

FOREIGN PATENT DOCUMENTS

| | | |
|---|---|---|
| EP | 188074 | 7/1986 |
| EP | 252638 | 1/1988 |
| FR | 2627514 | 8/1989 |
| GB | 2295060 | 5/1996 |

* cited by examiner

*Primary Examiner*—Anthony Dinkins
(74) *Attorney, Agent, or Firm*—James Creighton Wray; Meera P. Narasimhan

(57) ABSTRACT

Device for energizing a number of coils of a hook selection device for a weaving machine includes an electrical power supply source connected to the coils and a regulating device for regulating the current intensity in the coils. Each coil includes: a comparator for comparing the current intensity in the coil to a reference current intensity and a controllable current regulator (e.g. a chopper transistor) for regulating the current intensity in the coil in order to reach or approach the reference current intensity. The regulating device includes an electronic control circuit that is provided to control the current regulator of each coil of a number of coils, in order to reduce a variance between the actual current intensity in that coil and the reference current intensity measured by the comparator of that coil.

14 Claims, 1 Drawing Sheet

METHOD AND DEVICE FOR CONTROLLING A SELECTION DEVICE WITH SOLENOIDS FOR A WEAVING MACHINE

BACKROUND OF THE INVENTION

This invention relates to a device for energising a number of solenoids of a hook selection device for a weaving machine, comprising an electrical power supply source connected to the solenoids and a regulating device for regulating the current intensity in the solenoids.

This invention relates in particular to a device with which the current intensity in the solenoids is regulated in order to control the electromagnetic force the solenoid is exerting on the respective hooks.

Furthermore this invention also relates to a hook selection device for a weaving machine, which comprises such a device for energising a number of solenoids acting on hooks. A jacquard machine or a weaving machine that comprises such a hook selection device of course also falls within the scope of this invention.

From EP 0 188 074 a hook selection device for electronically controlled jacquard machines is known. This device comprises a series of flexible hooks of ferromagnetic material that are provided with an opening and a number of solenoids disposed in solenoid housings.

Each hook is opposite a solenoid housing and can be taken by a knife, that is moving up and down, to a position whereby the opening comes to stand in front of a projection provided at a fixed height. When a solenoid is energised, the hook is attracted. Because of this the projection arrives in the opening and on the subsequent downward movement of the knife, the hook remains hooked on to the projection. In this position the hook is selected.

In each solenoid housing one or two solenoids with iron core and pole plates are provided. When the hook is in front of the solenoid and the solenoid is not energised then there is a sufficiently large air gap between the hook and the pole plates in order that the hook does not hook on to the projection due to the effect of vibrations. In this position the hook is not selected and the hook will therefore move back down with the descending knife.

In order to select the hook the solenoid must therefore be capable of attracting a flexible spring hook of ferromagnetic material over a rather large air gap. The electromagnetic force required will therefore have to be sufficiently great. This electromagnetic force is proportional to the electromagnetic flux that is generated by the solenoid. The electromagnetic flux is proportional to the number of Ampere turns of the solenoid. The solenoid is energised by an electric voltage supply that is switched on or off by a switching transistor under control.

When applying an electric voltage to the solenoid the electric current in the circuit increases exponentially from a zero value until the regime current value is reached. When the electromagnetic flux has become sufficiently great in order to overcome the initially large air gap the hook will bend in order to lean against the solenoid housing. The energising of a solenoid can therefore be divided up into two times: a response time $t_1$, the time that is necessary for the hook to be attracted against the pole plates, and the hold time $t_2$, the time for holding the hook against the pole plates.

The weaving machines are becoming ever faster and the demand for faster hook selection devices in electronically controlled jacquard machines is therefore increasing. The response times of the solenoid can be shortened by applying a higher power supply voltage to the solenoids. The higher voltage causes a greater increase of current (dI/dt) and a greater current intensity (I) in the solenoid, so that the flux value whereby the hook will bend is reached faster. In other words the solenoid becomes faster. The higher voltage however also causes a hold current that is higher than necessary. The hold current is the current that the flux generates in order to exert an electromagnetic force on the hook that holds the hook on the pole plates with a minimum air gap. This measure therefore shortens the response time of the solenoid, but also produces a considerable increase in energy consumption. In view of the great number of selection devices in an electronically controlled jacquard device (going from a few thousand to 16 000), it will also be attempted to limit the energy consumption as much as possible.

A first measure that has been taken, according to the state-of-the-art, is to implement the energising in two phases: in a first phase an overenergising is applied of e.g. twice the hold voltage in order to obtain a short response time, and in a second phase a lower hold voltage is applied. The hold time of this hold voltage lasts much longer than the response time in the total selection time, so that this method already produces a considerable energy saving. The hold voltage is the electric voltage whereby the hold current flows through the solenoid.

This method of overenergising followed by a hold voltage requires a variable supply voltage that according to the state-of-the-art is effected with a switched power supply. This is called a voltage control. In view of the already mentioned great number of solenoids in a jacquard device, the power very quickly reaches several kW. At the relatively low supply voltage of 24–14 V that is used here the power supply has to be capable of furnishing hundreds of Amperes. These current intensities require electronic components that can withstand a high temperature stress and that are therefore relatively expensive and furthermore also sensitive to power failure due to overheating.

For the voltage control the supply voltage must be taken higher in order to compensate a few disadvantageous effects: namely variation of the electric resistance of the solenoid due to effect of the temperature and due to initial tolerances with the construction of the solenoid. This leads to higher hold currents than strictly necessary and therefore to energy wastage. Defective solenoids can only be detected on an idle machine, through which production losses sometimes arise with operating machines.

From the patent publication U.S. Pat. No. 4,511,945 a circuit for the energising of a solenoid is known, with which the electromagnetic force exerted by that solenoid can be regulated by controlling the current intensity in the solenoid, and not by controlling the electric voltage. The purpose of this circuit is to achieve a lower energy consumption of a solenoid in a fuel injector, and is therefore provided for the current control in one single solenoid. The circuit is furthermore also rather complex and comprises a large number of components, and is therefore also rather expensive.

In a hook selection device for a weaving machine generally thousands of solenoids are provided (e.g. 3,000 to 16,000 solenoids are standard numbers for jacquard machines). Since the known circuit is provided for energising one single solenoid, such a circuit would have to be provided per solenoid. Due to the large number of solenoids this would become too expensive, through which this circuit is not usable for a hook selection device for a weaving machine. Furthermore this circuit can also not be built sufficiently compact for this field of application.

SUMMARY OF THE INVENTION

A purpose of this invention is to provide a device with which solenoids of a hook selection device for a weaving machine can be energised, with which the electromagnetic force exerted by these solenoids can be regulated by a current control, and which due to its simplicity, compactness and low cost price is namely suitable for this field of application.

This aim is achieved by a device with the characteristics indicated in the first paragraph of this specification, of which per solenoid the regulating device comprises: a comparator provided for comparing the current intensity in the solenoid to a reference current intensity and a controllable current regulator, such as e.g. a chopper transistor, which is provided for regulating the current intensity in the solenoid in order to reach or approach this reference current intensity, while the regulating device comprises an electronic control circuit that is provided in order with several solenoids to control the current regulator of each solenoid in order to reduce a deviation between the actual current intensity in that solenoid and the reference current intensity measured by the comparator of that solenoid.

Such a device comprises a very limited number of components per solenoid, while the electronic control circuit (e.g. an integrated circuit) can be provided in order to drive several dozen solenoids (e.g. 48 solenoids) simultaneously. Such an energising device is particularly simple and compact to construct, and can be implemented at an acceptable cost price for controlling several thousand solenoids of a hook selection device for a weaving machine. Due to the limited number of components the device is also very reliable.

Furthermore through the utilisation of a current control a variable supply voltage is also unnecessary. By providing a relatively high voltage (for example more than double the value of the hold voltage and preferably 3.5 times this value) high current intensities can be avoided, so that less heat is produced. Because of this electric and/or electronic components with a lower temperature stressability can be used. These components are more reliable and inexpensive. Due to the lower supply current lighter feeder cables also have to be used. All of this makes the device still simpler and inexpensive. Furthermore with a current control it is possible to implement an efficient monitoring of the solenoids with simple means, so that defective solenoids can be traced almost immediately during the operation of the weaving machine and the weaving machine can be stopped. Because of this the production loss resulting from solenoid defects is reduced to a minimum. Such an automatic regulation occurs particularly fast and effectively. The weaving process can in this manner be performed with a maximum productivity and a minimum energy consumption.

With the device according to this invention the electronic control circuit is preferably provided in order to control the current regulator in function of a signal originating from the comparator. This produces a very simple and compact regulating device to construct.

The current regulator is preferably a chopper transistor. This transistor can be switched on and off in a certain rhythm (that can be altered by the control circuit), in order to obtain a certain current intensity. Other devices or components, in particular simple electric or electronic components that enable a rapid switching on and off with controllable frequency, are of course also suitable. With a switched driving of this chopper transistor the energy loss in the transistor is minimal. A digital regulator circuit is the best for this purpose.

The electronic control circuit is preferably also provided in order to determine the reference current. Because of this the reference current can automatically become different values, e.g. in order to generate an altered electromagnetic force with the solenoids. This is particularly necessary if in a first phase of the energising it is desired to bring about an overenergising (in order to select a hook very quickly), and in a subsequent second phase to generate a lower electromagnetic force that is sufficient to hold the hook selected.

According to this invention the device is indeed preferably provided in order to control means for generating a reference current so that in a first phase of the energising of the solenoids a higher reference current is generated than in a subsequent second phase. In this manner in a first phase an electromagnetic impetus can be exerted in order to alter the position of the hook, and in a subsequent second phase an electromagnetic holding force exerted, which is smaller than the impetus, in order to hold the hook in the altered position.

With a particularly preferred embodiment of this device the means for generating a reference current comprise a pulse width modulator.

The device according to the invention is also best implemented with a diode parallel to each solenoid, and with a sensor resistance in order to determine the current intensity through the solenoid. The aforementioned diode serves as a freewheeling diode.

In a most preferred embodiment of this invention, apart from the electronic control circuit, the regulating device only comprises the following discrete components per solenoid: a diode, a chopper transistor, a sensor resistance and a comparator, whereby the comparator is or is not provided with a filter.

In this most preferred embodiment the device comprises per solenoid a minimum number of simple components with a rather low cost price, which furthermore take up little space and can be assembled into a very compact unit. The electronic control circuit is furthermore provided in order to work together with a large number of solenoids, so that this device satisfies all requirements as to compactness, simplicity, cost price and reliability for use in a hook selection device for a weaving machine.

The electronic control circuit is preferably wholly or partly implemented as an integrated circuit. Moreover this control circuit can be composed of a part that can generate a reference current, a part "control and communication logic", and a part "current regulating logic".

The electronic control circuit best comprises digital components because these components enable a programming of the reference current. Furthermore through a suitable programming of the logic components a very efficient solenoid monitoring can also be performed during the operation of the machine.

The electric power supply source can be a simple power supply source with an invariable voltage, such as for example a mains transformer with bridge rectifier. This power supply need not even be stabilised. Mains tolerances up to for example 50% are permissible. Such a power supply source can be built particularly robustly and is consequently less susceptible to malfunctions and considerably cheaper.

This invention furthermore also encompasses a hook selection device for a weaving machine, comprising a number of electromagnetic solenoids, which comprises at least one device for energising solenoids with one or several of the above mentioned characteristics according to this invention.

This invention finally also relates to a jacquard machine or a weaving machine provided with a number of hooks and one or several hook selection devices according to the invention.

The invention is now further explained on the basis of the following detailed specification of a preferred hook selection device according to this invention and of the operation of this device. The purpose of this specification is only to give a clarifying example and can therefore in no way be interpreted as a restriction on the field of application of the invention or on the patent rights claimed in the claims.

BRIEF DESCRIPTION OF THE DRAWINGS

In this specification reference is made by means of reference numbers to the figures attached hereto, of which

DETAILED DESCRIPTION OF THE PREFERRED EMBODIMENTS

Figure 1:
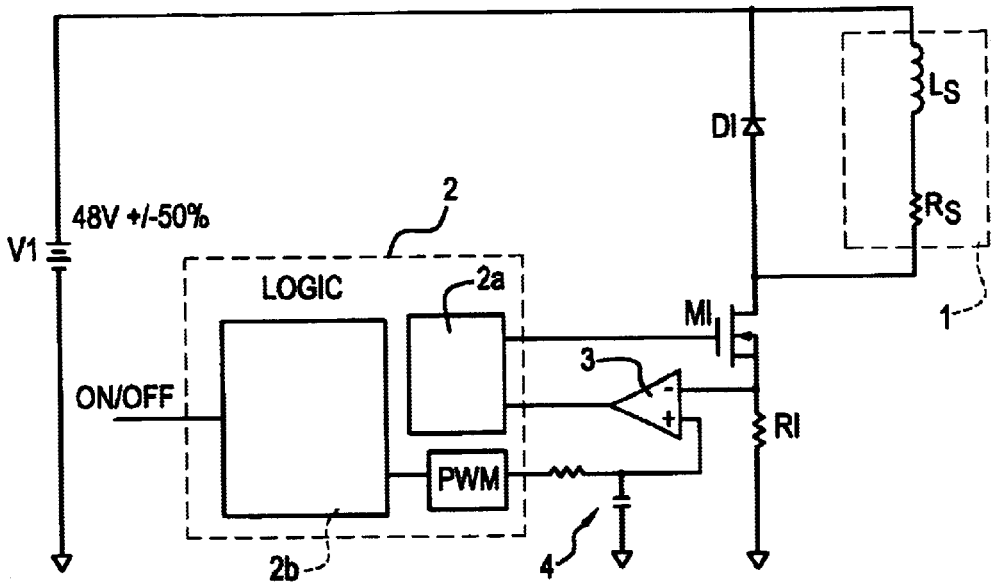
FIG. 1 is a block diagram of the part of an energising device working together with one solenoid of a hook selection device according to this invention.

The solenoid (1) is represented in these block diagrams by a resistance (Rs) in series with an inductance (Ls). A Power supply source $V_1$ with an invariable high voltage of for example 48 V is connected to this solenoid (1). A chopper transistor $M_1$ regulates the current in the solenoid (1). The current in the solenoid (1) is measured and compared in comparator (3) to a programmable reference current and in case of variation a correction is carried out by the regulator circuit **(2*a*). The reference current is determined by a PWM block: Pulse Width Modulation. This block supplies a square wave of which the analog output voltage is dependent on the duty cycle, i.e. on the ratio of the operating time or the on-time $T_{on}$ to the switching period T. The analog output voltage which is a measure for the reference current is applied to the comparator (3) over a filter (4)—represented by resistance and capacitor. The chopper transistor $M_1$ is of the MOSFET type or of the Bipolar transistor type. Every technology that can switch on and off quickly is suitable. Through the rapid switching on and off (chopping) the current is regulated in the solenoid (1). This switched driving is preferred to a linear driving. With a linear driving the transistor is used in its linear field, but moreover much energy is lost with generation of heat as a result. With switched driving the transistor is used is in two conditions: conductive or blocked. With this method the losses are extremely small and a digital regulator circuit can be used extremely efficiently. An ON/OFF signal is sent to the logic block (2*b*). With the ON position the selection element or the solenoid (1)** is activated through operation of the chopper transistor $M_1$ and the current is regulated in the solenoid in order to reach the reference current supplied by the PWM block. In the OFF position the chopper transistor $M_1$ is switched off and the solenoid is not energised.

In the first phase of the selection the supply voltage ($V_1$) is applied uninterruptedly to the solenoid (1). This supply voltage is approximately 3.5× the hold voltage of the state-of-the-art: a strong overenergising. Through the overenergising the current is built up very fast linearly in the solenoid (1), so that the response time of the solenoid (1) becomes shorter and the speed of the solenoid (1) much greater. In this first phase the reference current is high (e.g. 2× the reference hold current). As soon as the measured current in the solenoid (1) reaches a value of 2× the reference hold current the chopper transistor ($M_1$) comes into operation and the regulator circuit **(2*a*) ensures that this higher current is maintained for a short time according to the set high reference current. In a second phase the reference current is brought to a lower value by control from the logic block (2*b*), namely the reference value for the hold current. As soon as the reference current switches to the lower value for the hold current the regulator circuit (2*a*) ensures that the current in the solenoid (1)** drops until the value of the hold current is reached. With this method initially a strong electromagnetic force is developed very rapidly and for a short time in order to overcome the large air gap and the hook will be attracted very rapidly by the pole plates. Thereafter it is immediately switched over to an energy-saving hold current.

The minimum hold current is determined from the minimum holding force that is just sufficient for holding the hook against the pole plates with a minimum air gap. This provides a hold current of 75 mA for example for a solenoid (1) with n windings. The holding force is determined by the magnetic flux in the solenoid, which is determined by the number of Ampere windings. Through just that 75 mA by driving the current control through a solenoid with n windings the correct holding force is established irrespective of the resistance changes of the solenoid (1) through temperature variations or initial properties of the copper wire.

Figure 2:
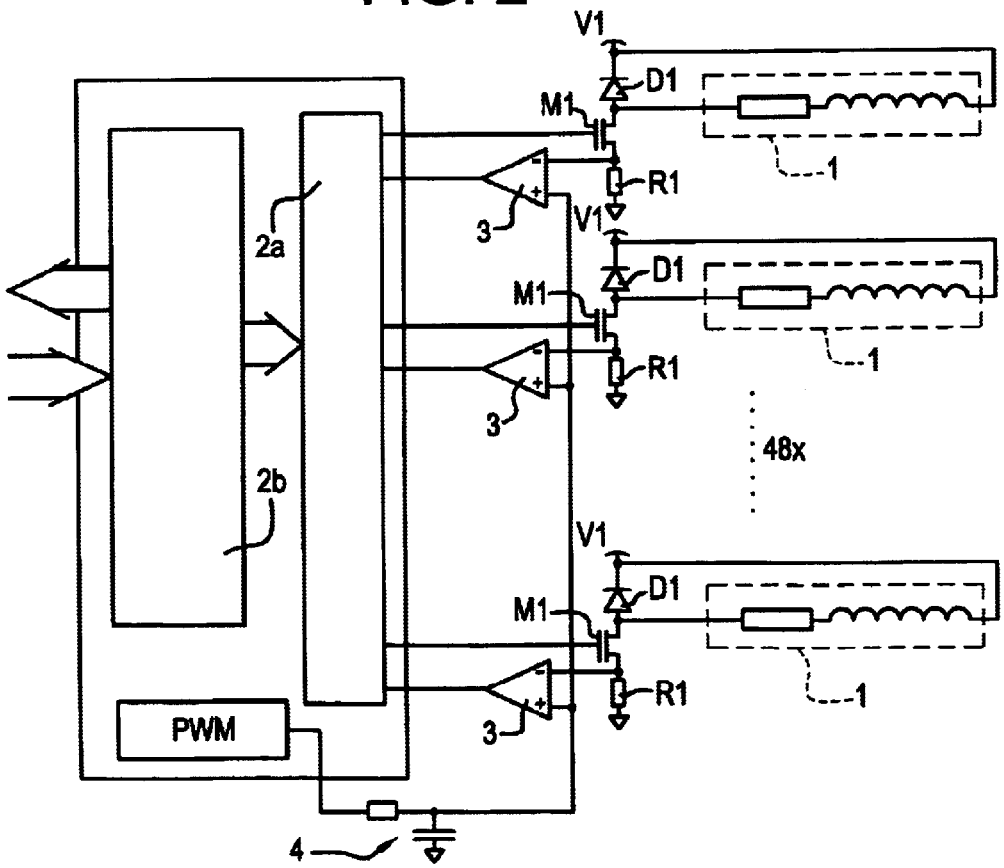
FIG. 2 is a block diagram in which a device for the controllable energising of 48 solenoids of a hook selection device according to this invention is schematically represented.

In this hook selection device (see FIG. 2) a control circuit (2) is provided per group of 48 electromagnetic solenoids, while a chopper transistor (M1), a sensor resistance (R1), a freewheeling diode (D1) connected in parallel and a comparator (3) with filter (4) are provided for each solenoid (1).

The electronic control circuit comprises a part "current regulating logic" **(2*a*) or a regulator circuit, and a part "control and communication logic" (2*b*)** or a logic block, and a pulse width modulator (PWM) in order to determine the reference current.

The control and communication logic **(2*b*) is connected to what can be called "the outside world". The ON/OFF signal for example is sent to this logic block (2*b*). This logic block (2*b*) also supports a pulse width modulator (PWM), and is connected to the regulator circuit (2*a*), which in its turn controls the chopper transistors (M1) of the 48 solenoids (1)**.

Each solenoid also has a comparator (3), to which on the one hand the output voltage coming from the pulse width modulator (PWM) is applied (over a "low pass" filter (4)), and to which on the other hand the voltage drop is applied over a sensor resistance (R1) of this solenoid (1). Depending on the deviation between these two voltages, (of which one is the measure for the reference current intensity and the other is a measure for the actual current intensity through the solenoid (1)) the comparator (3) sends a signal to the regulator circuit **(2*a*), which in its turn controls the chopper transistor (M1)** in order to reduce this deviation.

The solenoid energising device described here is energy-saving because of the fact that it operates according to the principle of current control. Through it simplicity, compactness, low cost price and reliability it is furthermore very well suited for a hook selection device for a weaving machine.

Each solenoid (1) has its own chopper transistor ($M_1$), which is placed close to the solenoid (1) on a printed circuit board: current paths are therefore very short. Because of the fact that the supply voltage ($V_1$) is relatively high, the supply current per printed circuit board is much smaller than according to the state-of-the-art. Heavy feeder cables are superfluous. The device therefore comprises less cable work and is less expensive.

The current measuring and regulator circuit (2) is preferably implemented in digital form by making use of an IC or ASIC or equivalent digital components such as FPGA or EPLD. These components enable a programming of the reference current. By means of a suitable programming of the logic components an efficient solenoid monitoring can be implemented with an operating machine. Possibly defective solenoids can be traced immediately and the machine can be stopped before several meters have been woven with defects.

The power supply source $V_1$ can simply consist of a mains transformer with bridge rectifier and need not even be stabilised. Large mains tolerances are permissible up to e.g. 50%. This power supply source can be built particularly robustly and is consequently less susceptible to malfunctions and is considerably cheaper.

What is claimed is:

1. Device for energising a number of solenoids (1) of a hook selection device for a weaving machine, comprising an electrical power supply source (V1) connected to the solenoids (1) and a regulating device for regulating the current intensity in the solenoids characterised in that per solenoid the regulating device comprises: a comparator (3) provided for comparing the current intensity in the solenoid (1) to a reference current intensity and a controllable current regulator, which is provided for regulating the current intensity in the solenoid (1) in order to reach or approach the reference current intensity, and that the regulating device comprises an electronic control circuit (2*a*, 2*b*) that is provided in order with several solenoids to control the current regulator (M1) of each solenoid (1) in order to reduce a deviation between the actual current intensity in the solenoid (1) and the reference current intensity measured by the comparator (3) of the solenoid (1).

2. Device for energising a number of solenoids of a hook selection device for a weaving machine, according to claim 1 characterised in that the electronic control circuit is provided in order to control the current regulator (M1) in function of a signal originating from the comparator (3).

3. Device for energising a number of solenoids of a hook selection device for a weaving machine, according to claim 1 characterised in that the current regulator is a chopper transistor.

4. Device for energising a number of solenoids of a hook selection device for a weaving machine, according to claim 1 characterised in that the electronic control circuit is provided in order to determine the reference current.

5. Device for energising a number of solenoids of a hook selection device for a weaving machine, according to claim 1 characterised in that the electronic control circuit is provided in order to control means for generating a reference current so that in a first phase of the energising of the solenoids a higher reference current is generated than in a subsequent second phase.

6. Device for energising a number of solenoids of a hook selection device for a weaving machine, according to claim 1 characterised in that the means for generating a reference current comprise a pulse width modulator.

7. Device for energising a number of solenoids of a hook selection device for a weaving machine, according to claim 1 characterised in that parallel to each solenoid (1) a diode (D1) is provided, and that the current intensity is determined by the solenoid by means of a sensor resistance (R1).

8. Device for energising a number of solenoids of a hook selection device for a weaving machine, according to claim 1 characterised in that apart from the electronic control circuit (2*a*, 2*b*), the regulating device only comprises the following discrete components per solenoid (1): a diode (D1), a chopper transistor (M1), a sensor resistance (R1) and a comparator (3) whether not provided with a filter.

9. Device for energising a number of solenoids of a hook selection device for a weaving machine, according to claim 1 characterised in that the electronic control circuit is or comprises an integrated circuit.

10. Device for energising a number of solenoids of a hook selection device for a weaving machine, according to claim 1 characterised in that the electronic power supply source (V1) to which the solenoid (1) is connected is a mains transformer with bridge rectifier.

11. Device for energising a number of solenoids of a hook selection device for a weaving machine, according to claim 1 characterised in that the electronic power supply source (V1) is a power supply source with an invariable voltage.

12. Device for energising a number of solenoids of a hook selection device for a weaving machine, according to claim 1 characterised in that the electronic control circuit (2*a*, 2*b*) comprises digital components.

13. Hook selection device for a weaving machine, comprising a number of solenoids, characterised in that it comprises at least one device for energising solenoids (1) according to claim 1.

14. Jacquard machine or weaving machine provided with a number of hooks and a device for selecting hooks, characterised in that it comprises a number of hook selection devices according to claim 13.

* * * * *